US006804979B2

(12) United States Patent
Gomez

(10) Patent No.: US 6,804,979 B2
(45) Date of Patent: Oct. 19, 2004

(54) APPARATUS FOR SEALING AN END PORTION OF A TUBULAR WORKPIECE IN A MOLD FOR INTERNAL HIGH-PRESSURE FORMING

(75) Inventor: Rafael Garcia Gomez, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 10/184,086

(22) Filed: Jun. 27, 2002

(65) Prior Publication Data

US 2003/0010079 A1 Jan. 16, 2003

(30) Foreign Application Priority Data

Jul. 14, 2001 (DE) ..... 101 34 321

(51) Int. Cl.[7] ..... B21D 26/02
(52) U.S. Cl. ..... 72/61
(58) Field of Search ..... 72/61, 58, 59, 72/60; 29/421.1

(56) References Cited

U.S. PATENT DOCUMENTS 453,410 A * 6/1891 Langerfeld ..... 72/20.2
701,549 A * 6/1902 Deering ..... 72/58
5,107,693 A * 4/1992 Olszewski et al. ..... 72/58
5,819,573 A * 10/1998 Seaman ..... 72/60

FOREIGN PATENT DOCUMENTS

DE 40 17 072 C2 11/1991

* cited by examiner

*Primary Examiner*—Lowell A. Larson
(74) *Attorney, Agent, or Firm*—Henry M. Feiereisen

(57) ABSTRACT

Apparatus for sealing an end portion of a tubular workpiece in a mold for internal high-pressure forming of the workpiece, includes a housing having a pressure compartment in fluid communication with an interior space of the workpiece. Hydraulic high-pressure fluid is supplied from a pressure source to the pressure compartment by a pressure application unit which further includes a pressure piston received in the pressure compartment and defined in the pressure compartment by an effective piston area which is greater than a cross sectional area in the interior space of an end portion of the workpiece. At least indirectly connected to the pressure piston is a sealing mandrel which interacts with the end portion of the tubular workpiece. A check valve is disposed in a passageway between the pressure compartment and the interior space of the workpiece for blocking in a direction to the pressure compartment.

12 Claims, 1 Drawing Sheet

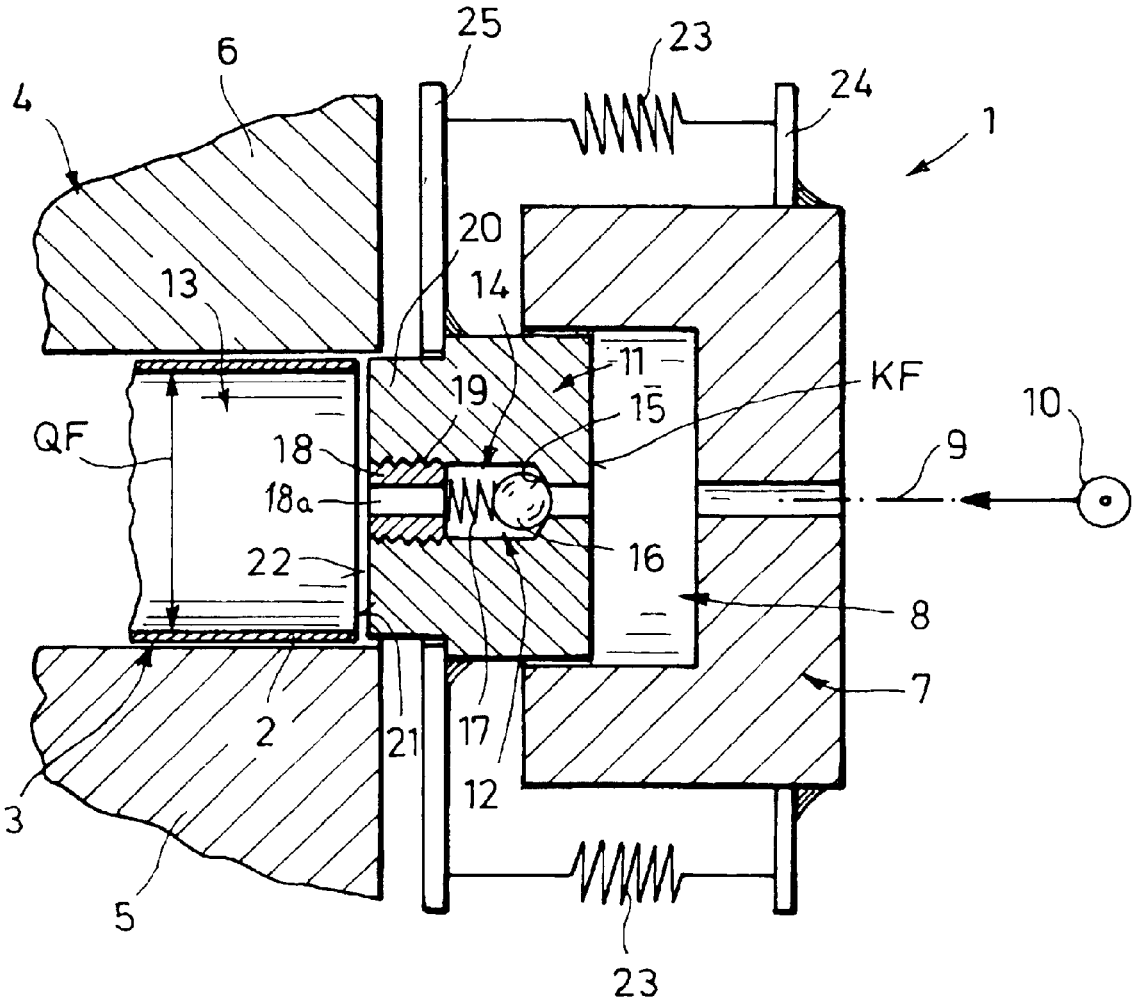
25
23
6
24
4
1
20
13
14
11
KF
19
15
10
QF
18
9
18a
16
22
8
7
2
21
17
12
3
5
23

APPARATUS FOR SEALING AN END PORTION OF A TUBULAR WORKPIECE IN A MOLD FOR INTERNAL HIGH-PRESSURE FORMING

CROSS-REFERENCES TO RELATED APPLICATIONS

This application claims the priority of German Patent Application Serial No. 101 34 321.3, filed Jul. 14, 2001, pursuant to 35 U.S.C. 119(a)–(d), the subject matter of which is incorporated herein by reference.

BACKGROUND OF THE INVENTION

The present invention relates to an apparatus for sealing an end portion of a tubular workpiece in a mold for internal high-pressure forming.

In general, internal high-pressure forming of tubular workpieces involves the use of a suitably contoured mold, which is so configured that a hydraulic high-pressure fluid is normally fed via at least one end portion into the interior space of the workpiece for implementing the forming process. The introduction of the hydraulic fluid may be effected by sealing mandrels which are moved in axial direction by means of hydraulic cylinders into the end portions of the workpiece or in the form of a bell over the end portions, and seal the interior space, in particular with the assistance of gaskets. The hydraulic cylinders together with closed valves oppose hereby the internal pressure applied for implementing the forming process of the workpiece that is carried out after establishing the sealing action.

It is also known to press the sealing mandrels against the end face of the workpiece with the assistance of an annular serrated seal, a stepped seal or a conical seal. It is also conceivable to use the sealing mandrels for forming a conical seal (splined seal).

German Pat. No. 40 17 072 C2 discloses sealing mandrels which are each supported by an additional hydraulic cylinder to produce the same internal pressure that is required for shaping the workpiece so that a counterforce is directly generated. There is only need for the hydraulic unit to apply the differential pressure required for sealing and/or supply of material.

It would be desirable and advantageous to provide an improved apparatus for sealing an end portion of a tubular workpiece in a mold for internal high-pressure forming, which obviates prior art shortcomings and which has a simple construction with less single components, while being capable to significantly reduce clock times for a forming process.

SUMMARY OF THE INVENTION

According to one aspect of the present invention, an apparatus for sealing an end portion of a tubular workpiece placed in a mold for internal high-pressure forming of the workpiece, includes a housing having a pressure compartment in fluid communication with an interior space of the workpiece, and a pressure application unit including a pressure source for supply of a hydraulic high-pressure fluid to the pressure compartment, a pressure piston guidingly received in the pressure compartment and defined in the pressure compartment by an effective piston area which is greater than a cross sectional area in the interior space of an end portion of the workpiece, a sealing mandrel at least indirectly connected to the pressure piston and interacting with the end portion of the tubular workpiece, and a check valve disposed in an axial passageway between the pressure compartment and the interior space of the workpiece for blocking in a direction to the pressure compartment.

An essential feature of the present invention is the difference between the effective piston area of the pressure piston in the pressure compartment and the inner cross sectional area in the end portion of the workpiece. In this way, the sealing mandrel applies continuously a force against the end face of the workpiece, as the internal pressure rises in the workpiece, so that application of a required sealing force is ensured, regardless of the respective internal pressure. This sealing force can then be utilized to supply material into the mold or shaping zone of the workpiece.

At the start of the forming process, hydraulic high-pressure fluid from the pressure source is supplied to the pressure compartment. As the passageway in the pressure piston for interconnecting the pressure compartment with the interior space of the workpiece is normally closed off by the check valve in direction of the pressure compartment, pressure builds up in the pressure compartment. As a consequence, the pressure piston is moved toward the end face of the workpiece until the sealing mandrel contacts the workpiece to seal the interior space thereof. As pressure further rises in the pressure compartment, the closing force of the check valve is eventually exceeded so that the check valve opens and pressure fluid is allowed to stream to the interior space of the workpiece. Internal pressure in the workpiece builds up and the workpiece is shaped to conform to the contour of the dies of the mold.

Once the internal high-pressure forming process is over, pressure in the pressure compartment is lowered to zero so that the pressure piston returns to its initial position and the shaped workpiece can be removed for further processing.

Of course, the apparatus according to the present invention is applicable not only one for end of the workpiece but also for both ends.

According to another feature of the present invention, there may be provided a restoring element for moving the pressure piston back to the initial position, when a fluid flow between the pressure source and the pressure compartment is cut. The restoring member may be a mechanical, electrical, pneumatic or hydraulic restoring member. Examples include compression springs, tension springs, pneumatic cylinders or hydraulic cylinders.

Through the configuration of the apparatus according to the invention, there is no need to provide additional hydraulic units or complex control systems to implement the movement of the pressure piston and the sealing action via the sealing mandrel. The movement of the pressure piston and the sealing mandrel can be implemented by the same pressure source that provides the internal pressure for the actual internal high-pressure forming process. Moreover, the sealing action and the application of a counterforce are solely realized from this pressure source. Process times of the internal high-pressure forming operation are significantly reduced because the sealing mandrel is displaced to realize the sealing action as soon as the internal pressure rises.

The apparatus according to the present invention is suitable in particular for hydroforming with mechanical presses for the following reason. During hydroforming operation, pressure buildup is effected in a very short period. Thus, it is sufficient to provide the end face of the sealing mandrel of planar configuration to effect a sealing of the end face of the workpiece and to thereby allow a buildup of the required internal pressure for expanding the workpiece. The planar configuration further allows an expansion directly in the area of the contact surface between the end face of the sealing mandrel and the end face of the workpiece. As a consequence, the workpiece can be directly shaped to the final contour and a subsequent trimming of the ends is avoided.

BRIEF DESCRIPTION OF THE DRAWING

Other features and advantages of the present invention will be more readily apparent upon reading the following description of currently preferred exemplified embodiments of the invention with reference to the accompanying drawing, in which FIG. 1 is a schematic illustration of an apparatus in accordance with the present invention for sealing an end portion of a tubular workpiece in a mold for internal high-pressure forming.

DETAILED DESCRIPTION OF PREFERRED EMBODIMENTS

Turning now to FIG. 1, there is shown an apparatus, generally designated by reference numeral 1, for sealing an end portion 2 of a tubular workpiece 3, in a mold, generally designated by reference numeral 4, through internal high-pressure forming. The mold 4 includes a bottom die 5 and a top die 6, which are moveable relative to one another in a manner not shown and are determinative for the configuration of the workpiece 3. Arranged in proximity to the end face of the workpiece 3 is a stationary housing 7 which includes a pressure compartment 8 connected via a supply line 9 to a pressure source 10 for a hydraulic high-pressure fluid. Sealingly guided in the pressure compartment 8 is a pressure piston 11, which has a stepped axial passageway 12 for interconnecting the pressure compartment 8 with the interior space 13 of the workpiece 3. Disposed in the passageway 12 is a check valve 14, which is biased to lock in the direction of the pressure compartment 8. The check valve 14 includes a spherical sealing member 16, which is urged against a conical valve seat 15 by a helical compression spring 17 extending between the sealing member 16 and an end face of a screw 18. The screw 18 is threadably engaged in a threaded portion 19 of the passageway 12 and is formed with a through channel 18*a* in fluid communication with the passageway 12.

In the non-limiting example of FIG. 1, the pressure piston 11 is connected to a sealing mandrel 20, which has a planar end face 22 for sealing a confronting circular ring shaped end face 21 of the workpiece 3. Currently preferred is a single-piece configuration between the pressure piston 11 and the sealing mandrel 20, although it is certainly possible to provide the pressure piston and the sealing mandrel as two separate components which are suitably coupled to one another.

The housing 7 and the pressure piston 11 are interconnected by restoring members 23 in the form of helical tension springs, whereby, the housing 7 and the pressure piston 11 are provided with lateral extensions 24, 25 between which the restoring members 23 extend to bias the pressure piston 11 to seek the retracted initial position in which the pressure piston 11 is moved away from the mold 4.

As shown in FIG. 1, the pressure piston 11 has in the pressure compartment 8 an effective piston face area KF which is greater than a cross sectional area of the interior space 13 in the end portion 2 of the workpiece 3. As a consequence, a force is applied by the pressure piston 11 at all times during rising internal pressure in the workpiece 3 against the end face 21 of the workpiece 3 to ensure the required sealing force independent from the internal pressure.

The forming process of the tubular workpiece 3 by means of internal high pressure is as follows: The mold 4 is first opened and the workpiece 3 to be shaped is placed in the bottom die 5. The top die 6 is then lowered to close the mold 4. Subsequently, hydraulic high-pressure fluid flows from the pressure source 10 to the pressure compartment 8. As the check valve 14 is forced by the spring 17 against the valve seat 15, entry to the passageway 12 is barred so that pressure builds up in the pressure compartment 8. The rising pressure moves the pressure piston 11 in the direction of the workpiece 3 until the end face 22 of the sealing mandrel 20 abuts against the end face 21 of the workpiece 3 to seal the interior space 13 of the workpiece 3.

As the connection between the pressure compartment 8 and the pressure source 10 is maintained, pressure keeps building up in the pressure compartment 8 until this pressure reaches a level sufficient to overcome the spring force of the compression spring 17 and thus to open the check valve 14 so that high-pressure fluid can flow from the pressure compartment 8 via the passageway 12 and the through channel 18*a* into the interior space 13 of the workpiece 3 to subsequently shape the workpiece 3 to conform to the contour of the bottom die 5 and the top die 6.

After conclusion of the internal high-pressure forming process, the pressure compartment 8 is separated from the pressure source 10. The pressure drops to zero and the restoring members 23 return the pressure piston 11 back to the initial position. The check valve 14 closes again the passageway 12 in the pressure piston 11 by resting against the valve seat 15.

Thereafter, the mold 4 is opened by moving the bottom and top dies 5, 6 apart to allow removal of the shaped workpiece 3.

It will be appreciated by persons skilled in the art that the apparatus 1 must contain additional means which does not appear in the foregoing Figure, e.g. a control unit for executing the sealing and forming processes. However, this unit, like much other necessary devices, is not part of the invention, and has been omitted from the Figure for the sake of simplicity.

While the invention has been illustrated and described as embodied in an apparatus for sealing an end portion of a tubular workpiece in a mold for internal high-pressure forming, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. Apparatus for sealing an end portion of a tubular workpiece placed in a mold for internal high-pressure shaping of the workpiece, said apparatus comprising:

a housing having a pressure compartment in fluid communication with an interior space of the workpiece; and a pressure application unit including a pressure source for supply of a hydraulic high-pressure fluid to the pressure compartment; a pressure piston constructed for displacement solely by admission of hydraulic fluid from the pressure source and accompanying increase in pressure within the pressure compartment and defined in the pressure compartment by an effective piston area which is greater than a cross sectional area in the interior space of an end portion of the workpiece, a sealing mandrel at least indirectly connected to the pressure piston and constructed for forced flat engagement against a confronting end face of the tubular workpiece, thereby sealing an interior of the tubular workpiece without projecting into the tubular workpiece, and a check valve disposed in an axial passageway an the pressure piston and the sealing mandrel between the pressure compartment and the interior space of the workpiece for blocking in a direction to the pressure compartment.

2. The apparatus of claim 1, and further comprising a restoring element for moving the pressure piston back to the initial position, when a fluid flow between the pressure source and the pressure compartment is cut.

3. The apparatus of claim 2, wherein the restoring member is an element selected from the group consisting of mechanical, electrical, pneumatic and hydraulic restoring member.

4. The apparatus of claim 3, wherein the restoring member is an element selected from the group consisting of compression spring, tension spring, pneumatic cylinder, and hydraulic cylinder.

5. Apparatus for sealing an end portion of a tubular workpiece placed in a mold for internal high-pressure shaping of the workpiece, said apparatus comprising a pressure application unit including a housing having a compartment, a piston constructed for displacement solely by admission of hydraulic fluid from the pressure source and accompanying increase in pressure within the compartment and having a piston face on a compartment-proximal end and interacting with a mandrel on a compartment-distal end, and a check valve, disposed in an axial passageway of the piston between the compartment and an interior space of the workpiece, for controlling a flow of hydraulic fluid under pressure from the pressure compartment to th interior space such that the piston is moveable in a first phase during pressure buildup in the compartment in a direction of the workpiece to urge an end face of the mandrel into a flat engagement against a confronting end face of the tubular workpiece, thereby sealing an interior of the tubular workpiece without projecting into the tubular workpiece, and hydraulic fluid is allowed to flow in a second phase into the interior space of the workpiece, as the pressure in the compartment exceeds a closing force of the check valve, to carry out a shaping operation of the workpiece while the mandrel is maintained in sealing contact against the end face of the tubular workpiece.

6. A mold for internal high-pressure forming of a tubular workpiece, comprising:

a pair of dies defining a space for receiving a workplace; and a pressure application unit for sealing an end portion of the workpiece, when placed in the space between the dies, and applying an internal hydraulic pressure in an interior space of the workpiece, said pressure application unit including a housing having a compartment, a piston constructed for displacement solely by admission of hydraulic fluid from a pressure source and accompanying increase in pressure within the compartment and having a piston face on a compartment-proximal end and interacting with a mandrel on a compartment-distal end, and a check valve, disposed in an axial passageway of the piston between the compartment and an interior space of the workpiece, for controlling a flow of hydraulic fluid under pressure from the pressure compartment to the interior space such that the piston is moveable in a first phase, during pressure buildup in the compartment in a direction of the workpiece to urge an end face of the mandrel into a flat engagement against a confronting end face of the tubular workpiece, thereby sealing an interior of the tubular workpiece without projecting into the tubular workpiece, and hydraulic fluid is allowed to flow in a second phase into the interior space of the workpiece, as the pressure in the compartment exceeds a closing force of the check valve, to carry out a shaping operation of the workpiece while the mandrel is maintained in sealing contact against the end face of the tubular workpiece.

7. The mold of claim 6, wherein the closing force of the check valve is realized by a spring element.

8. The mold of claim 7, wherein the check valve includes a ball urged by the spring element to cut a fluid flow through the passageway, said sealing unit including a screw disposed in the passageway downstream of the ball and having an internal axial through channel for establishing a fluid communication between the passageway and the interior space in the second phase.

9. The mold of claim 6, wherein the piston face has an area which is greater than a cross sectional area in the interior space of the end portion of the workpiece.

10. The mold of claim 6, and further comprising a restoring element for moving the piston back to an initial position, when a fluid flow between the pressure source and the pressure compartment is cut.

11. The mold of claim 10, wherein the restoring member is an element selected from the group consisting of mechanical, electrical, pneumatic and hydraulic restoring member.

12. The mold of claim 11, wherein the restoring member is an element selected from the group consisting of compression spring, tension spring, pneumatic cylinder, and hydraulic cylinder.

* * * * *